United States Patent [19]

Ross et al.

[11] Patent Number: 4,748,813

[45] Date of Patent: Jun. 7, 1988

[54] METHOD OF OPERATING A THERMAL ENGINE POWERED BY A CHEMICAL REACTION

[75] Inventors: John Ross, Stanford, Calif.; Claus Escher, Nieder-Ronstadt, Fed. Rep. of Germany

[73] Assignee: The Board of Trustees of the Leland Stanford Junior University, Stanford, Calif.

[21] Appl. No.: 77,591

[22] Filed: Jul. 24, 1987

Related U.S. Application Data

[63] Continuation of Ser. No. 758,472, Jun. 23, 1985, abandoned.

[51] Int. Cl.[4] ..... F01K 25/00

[52] U.S. Cl. ..... 60/643; 60/645; 60/721; 60/670

[58] Field of Search ..... 60/643, 645, 721, 670, 60/651, 671, 650, 682

[56] References Cited

U.S. PATENT DOCUMENTS 4,031,705 6/1977 Berg ..... 60/618 X

*Primary Examiner*—Allen M. Ostrager

*Attorney, Agent, or Firm*—Flehr, Hohbach, Test, Albritton & Herbert

[57] ABSTRACT

The invention involves a novel method of increasing the efficiency of a thermal engine. Heat is generated by a non-linear chemical reaction of reactants, said heat being transferred to a thermal engine such as Rankine cycle power plant. The novel method includes externally perturbing one or more of the thermodynamic variables of said non-linear chemical reaction.

12 Claims, 4 Drawing Sheets

METHOD OF OPERATING A THERMAL ENGINE POWERED BY A CHEMICAL REACTION

This invention was made with Government Support under Contract No. DE-AT03-82ER13018 awarded by the Department of Energy. The Government has certain rights under this invention.

This is a continuation of application Ser. No. 758,472 filed June 23, 1985, now abandoned.

This invention relates generally to a method of operating a thermal engine and more particularly to the method of operating a thermal engine powered by a chemical reaction to increase power output and reduce dissipation.

The laws of classical thermodynamics, J. G. Kirkwood, I. Oppenheim, *Chemical Thermodynamics,* McGraw-Hill Book Co., Inc., New York, 1961, place upper limits on the efficiency of thermal engines. The Carnot engine is the most efficient thermal engine and a schematic representation of its operation is shown in FIG. 1. Let the working fluid of a Carnot engine be a gas described by its pressure plotted on the ordinate, its volume plotted on the abscissa, and its temperature. The cycle of a Carnot engine consists of an isotherm, point a to point b at a high temperature $T_1$, in which the Carnot engine is coupled to a heat reservoir at temperature $T_1$. This is followed by an adiabatic expansion, point b to point c, and then isothermal compression, point c to point d, at a lower temperature $T_2$ in which the engine is coupled to a heat reservoir at the temperature $T_2$. The final step is an adiabatic compression from point d to point a and the cycle then begins anew. The efficiency of a Carnot engine, which is the maximum efficiency allowed according to the first and second law of thermodynamics, is given by $$\eta = \frac{W}{Q_1} = 1 - \frac{T_2}{T_1}, \tag{1}$$

where $\eta$ is the efficiency, W the work done by the engine in the surroundings per cycle, and $Q_1$ the heat taken from the reservoir at the higher temperature in each cycle. In order to attain the maximum efficiency of a Carnot engine all processes must be run reversibly. For a reversible flow of heat, such as the heat transferred from the heat reservoir at $T_1$ to the Carnot engine, the temperature of the Carnot engine must also be at $T_1$. For reversible processes the intensive variables, such as temperature, must be the same for the heat reservoir and the engine. However, if these temperatures are the same, the flow of heat is infinitely slow. In its simplest form, the equation for the flow of heat is $$\frac{dQ}{dt} = \frac{\alpha' A}{l}(T_1 - T_1') \tag{2}$$

where the left-hand side of the equation gives the flow of heat per unit time and on the right-hand side $\alpha'$ is a thermal conduction coefficient, A is the area across which heat flows from the heat reservoir to the engine, l is the thickness of the wall between the heat reservoir and the engine, $T_1$ is the temperature of the heat reservoir and $T_1'$ the temperature of the heat engine. If $T_1 = T_1'$, as is required for a reversible process, then the flow of heat is zero unless the area of contact between the heat reservoir and the thermal engine goes to infinity, or the thickness of the wall between the heat reservoir and the heat engine goes to zero. Neither of these two conditions is physically realistic, "Thermodynamic Processes, Time Scales, and Entropy Production," J. Phys. Chem. 86, 71 (1982), Victor Fairen, Michael D. Hatlee and John Ross. Hence, for reversible processes the flow of heat is infinitely slow and the time required to complete a Carnot cycle is infinitely long. For these conditions, the power output of a Carnot engine, defined as the work done per cycle divided by the time necessary to complete the cycle, is zero.

In order for a thermal engine to produce power, F. L. Curzon and B. Ahlborn, Am. J. Phys. 43, 22 (1972), the cycle time must be less than infinitely long and hence the flow of heat from the reservoir at high temperature to the thermal engine, and from the thermal engine to the heat reservoir at the lower temperature, must occur in finite time. For that requirement to be fulfilled, the temperature of the heat engine, connected to the heat reservoir at $T_1$, must be less than $T_1$, say $T_1'$. Then according to Equation 2, the flow of heat will be finite for finite area A and wall thickness l since $(T_1 - T_1')$ is not zero. A similar statement applies for the temperature of the heat engine connected to the heat reservoir at the lower temperature $T_2$ which must be larger, say $T_2'$, FIG. 1, such that the difference in temperature $T_2' - T_2$ is non-zero and the flow of heat from the heat engine to the reservoir at the lower temperature occurs in finite time. Under these conditions, the time necessary to complete a cycle can be finite and hence, if work is done by the thermal engine in a finite time, the power output is non-zero.

For thermal engines with non-zero power output there occurs dissipation due to the irreversible processes of heat conduction between the heat reservoirs and the engine. The dissipation, S. R. deGroot and P. Mazur, *Non-equilibrium Thermodynamics,* North Holland, Amsterdam, 1962, is related to the rate of entropy production, dS/dt, which for the irreversible process of heat conduction between the temperatures $T_1$ and $T_1'$ is $$\frac{dS}{dt} = \frac{\alpha A}{l} \frac{(T_1 - T_1')^2}{T_1 T_1'} \tag{3}$$

If power output of the thermal engine is required, there must be irreversible processes and there must be dissipation which reduces the efficiency of the engine compared to the Carnot engine. The efficiency now depends on the nature of the irreversible processes; for linear heat conduction between the heat reservoirs and the heat engine, the efficiency at maximum power production is, Curzon and Ahlhorn, loc.cit.

$$\eta = 1 - (T_2/T_1)^{\frac{1}{2}} \tag{4}$$

For a typical power plant, the ratio of $T_2/T_1$ is about 0.5. Hence, the efficiency of a reversible Carnot engine would be 0.5. However, the efficiency of the thermal engine with maximum power output under the same conditions of the temperature $T_2$ and $T_1$ is considerably reduced from 0.5 to approximately 0.3. The reduction in efficiency is due to the dissipation in the irreversible processes necessitated by the requirements of power output.

Consider next the source of heat of a thermal engine and let this source be a chemical reaction such as the combustion of methane or any other fuel. Such reactions are said to be exothermic in that they produce heat. Let such a combustion proceed in a vessel as shown in FIG. 2 where there is an input stream of fuel, another input stream of air or oxygen necessary for the combustion and an exit stream of the heated chemical products of the combustion reaction at temperature T. the flow of input reactants is controlled by valves or pumps 8 and 9. These chemical products at temperature T provide the heat source at the higher temperature for a thermal engine which is made to operate between that high temperature reservoir and a lower temperature reservoir designated by the temperature $T_{ex}$. Fuel and air at a temperature $T_{ex}$ are injected into the combustion chamber at a given rate. Chemical reaction occurs at a given rate in the combustion chamber to produce a heat at a given rate. This heat is supplied to the thermal engine which then produces work at a given rate and rejects some of the heat to the heat reservoir at the lower temperature, $T_{ex}$. Hence, this engine has a given power output. The necessary, irremovable, irreversible processes attending the power production in this thermal engine are those due to the chemical reaction in the combustion chamber, which must occur in a finite time, and due to thermal conduction between the combustion chamber and the surroundings, between the reservoir at temperature T and thermal engine, and between the thermal engine and the heat reservoir at temperature $T_{ex}$. The equation for dissipation due to chemical reaction, with reactants at the temperature $T_{ex}$ and chemical products finally at the same temperature, is $$\text{dissipation} = \Delta A \text{ (rate)} \tag{5}$$

where $\Delta A$ is the Helmholtz free energy difference between reactants and products at that temperature and the "rate" means rate of the chemical reaction. The dissipation as defined here is related to the rate of entropy production. For a steady flow of fuel and air into the combustion chamber and for a steady rate there will be a fixed Helmholtz free energy difference between reactants and products, a fixed rate of chemical reaction, and a fixed dissipation. $\Delta A$ is the maximum work which the chemical reaction can do if run reversibly. The chemical reaction, however, is not run reversibly in order to supply heat at a given rate so that power may be produced. Hence, for the sake of power production there must be dissipation. This is shown schematically in FIG. 3 in which we indicate that for reversible processes by definition the dissipation is zero, whereas for processes with power production, which must be irreversible, there must be dissipation. Power plants are run normally with fixed input rates of fuel and air, and we designate such operation as steady state operation.

It is an object of this invention to provide a method to reduce dissipation from that in steady state operation and thereby increase the power output.

It is another object of this invention to provide a method to increase the output power of a thermal engine driven by chemical reactions by means of applying external, induced periodic perturbations coupled to non-linearities in the chemical reaction.

In accordance with the invention, the efficiency is increased and dissipation in heat engines in decreased by generating heat by a non-linear chemical reaction in a closed vessel and externally perturbing the non-linear chemical reaction in a manner that phase shifts conjugate quantities such as pressure/volume, flux, concentrations, etc., so that positive work is produced.

The foregoing and other objects of the invention will be more clearly understood from the following description taken together with the accompanying drawings of which:

FIG. 1 shows the operating cycle of a Carnot engine.

FIG. 2 schematically shows a combustion process in a closed vessel.

FIG. 3 schematically shows the dissipation in a heat engine for various modes of operation.

Let the steady state mode of operation of the thermal engine discussed be labelled a. The engine is fed by an exothermic reaction with some non-linearity in the reaction system. Let mode b of operation be one in which an external periodic perturbation is applied to the combustion reaction for the same fuel consumption as in mode a. By the term 'periodic perturbations' is meant varying one or more of the thermodynamic variables such as the volume, or input fluxes of the non-linear chemical reaction at predetermined frequencies. One chooses a pair of canonically conjugate thermodynamic variables and for the purpose of illustration, the external pressure and the volume are chosen. One of these variables must be coupled to an essential non-linearity in the reaction system. That non-linearity could be the common type of temperature dependence of the rate coefficient in which that rate coefficient is proportional to an exponential function of the temperature $$\text{rate coefficient} = ce^{-E^*/RT} \tag{6}$$

where c is a constant (but need not be), $E^*$ is the activation energy of the reaction taken to be constant for simplicity (but need not be), k is Boltzmann's constant, and T is the absolute temperature.

Another common non-linearity is due to the concentration dependencies of the rate on the concentration of reactants, chemical intermediates and possibly products. If the total rate of the reaction depends on the concentration of any species other than the first power of the concentration, the volume dependence of the reaction is non-linear. Other non-linearities, such as due to complex reaction mechanisms leading to oscillatory reactions, for example, are included in this invention. Thus, non-linear in the present invention means a chemical rate flow which depends on any thermodynamic variable, such as the concentrations of the chemical species, to a power other than unity, and similarly for temperature, etc. (As an example, Eq. 10 is linear in the concentration A but non-linear in the temperature T; Eq. 11 is non-linear in concentration as it depends on the first power in A, the first power in F and hence on the second power in concentrations. See, for example, S. R. de Groot and P. Mazur, *Non-Equilibrium Thermodynamics*, Dover Pub., N.Y., 1984.

Figure 1:
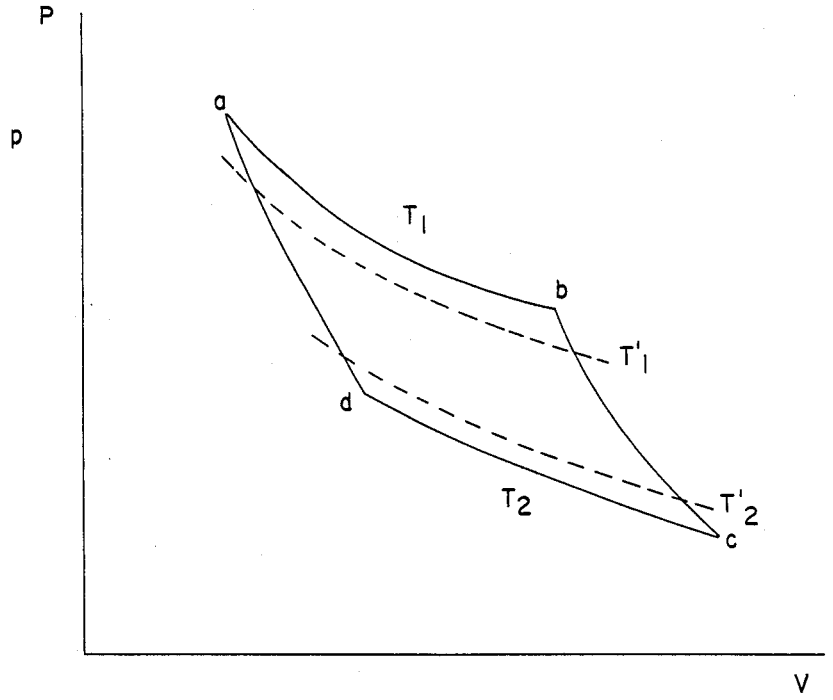
Figure 2:
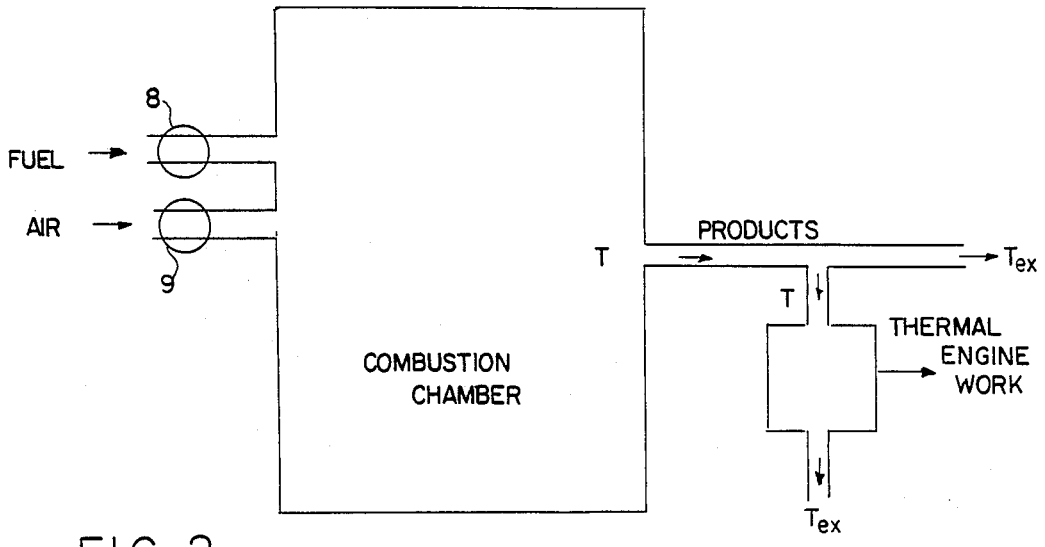
Figure 3:
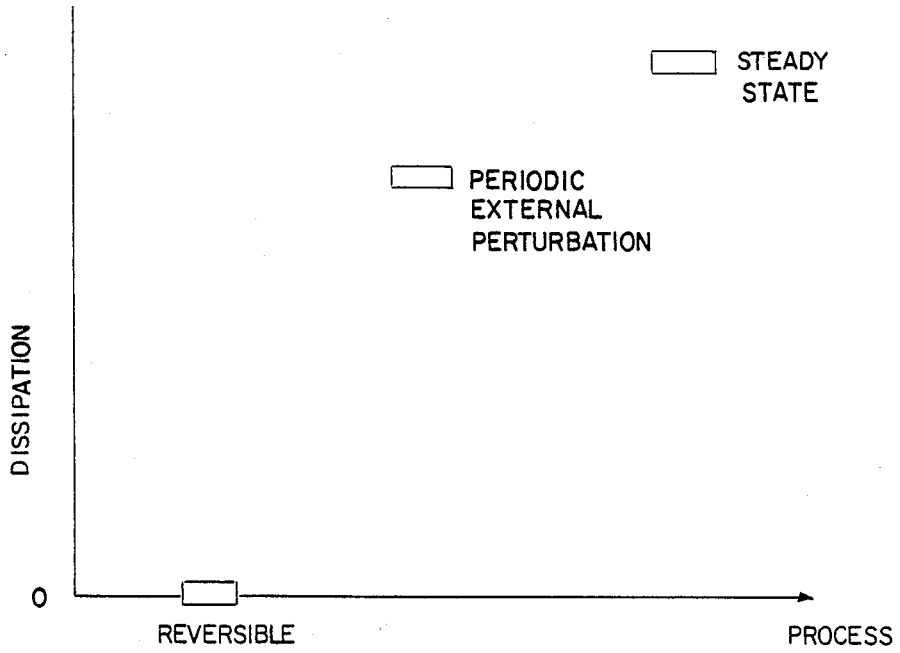
Figure 4:
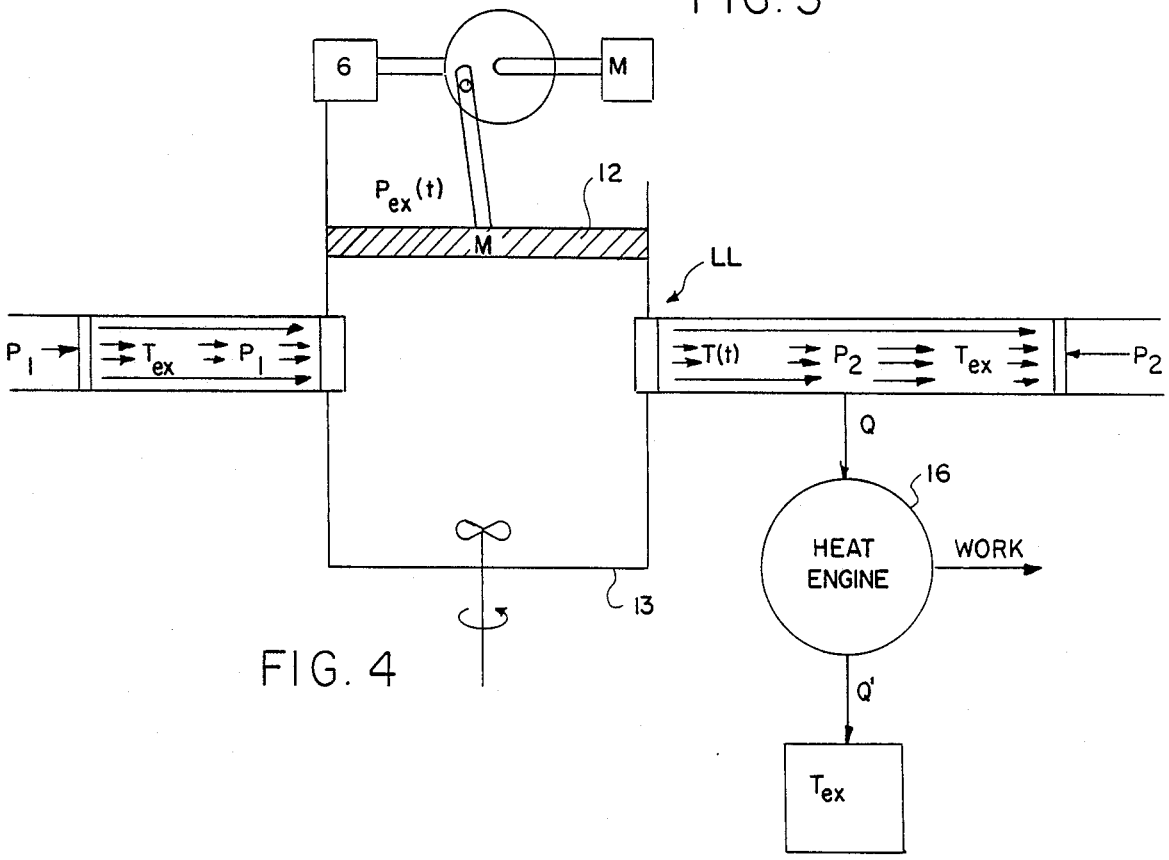
FIG. 4 shows a continuous flow stirred tank reactor which is in contact with a heat exchange fluid and a pressure/volume work reservoir.

Mode b of operation with external periodic perturbations is illustrated in FIG. 4, which shows continuous fluid stirred tank reactor 11. Coupling to the reactor from a pressure/volume work reservoir is by a movable piston 12. The piston 12 may be driven by drive means such as the crank 15 driven by a power source, which may comprise a motor M, through a shaft which is perpendicular to the crank. Power can be extracted by a generator G connected to the crank shaft. Exothermic or endothermic reactions take place in the vessel or tank 13 which alters the temperatures of the outgoing chemicals from that of the incoming ones. We make the non-essential assumption that the reactants in the input have the same temperature as the heat exchange fluid in exchanger 14. The temperature difference between the products at temperature T(t) and the heat exchange fluid at temperature $T_{ex}$ runs the heat engine 16. If the pressure in the chamber is fixed, only the heat engine can do work.

In accordance with one embodiment of the invention, periodic variations in the external pressure are applied and the vessel volume is changed. Fuel and air are injected into a combustion chamber at temperature $T_{ex}$ which now has a variable volume. The reaction occurs and again the hot reaction products are removed by an exit pipe at the temperature T(t). The exit pipe reservoir is connected to a heat engine 16 which operates between that high temperature and a lower temperature, $T_{ex}$. Heat may leak from the combustion chamber to the surroundings.

In mode b, the canonically conjugate pair is the external pressure and the volume and the external pressure is varied periodically. Any work done by the motion of the piston 12, with mass m, either by the surroundings on the system or by the system on the surroundings must be accounted for.

In the publications entitled, "Reduction of Dissipation in a Thermal Engine by Means of Periodic Changes of External Constraints," Claus Escher and John Ross, J. Chem. Phys. (1985), and "Increased Power Output and Resonance Effects in a Thermal Engine Driven by a First or Second Order Model Reaction," Kloczkowski and John Ross, J. Chem. Phys. (1985), incorporated herein by reference, the power outputs based on the first law of thermodynamics, Newton's law of motion for the piston and the reaction kinetics in the reaction vessel leads to an expression for the power produced by the motion of the piston due to an external perturbation of the external pressure as $$P_p^{(b)} \doteq \left(\alpha + \sum_i c_{pi} N_i^{(out)}\right)(\langle T\rangle_a - \langle T\rangle_b). \tag{7}$$

Thus whenever there is a positive power output via the piston, the average temperature of the reactant contents in the perturbed case, b is lower than the unperturbed case, a.

The difference in total power output between the perturbed (b) and unperturbed (a) case is shown to be $$\Delta P = \alpha(\langle T\rangle_a - \langle T\rangle_b) + \sum_i c_{pi} n_i^{(out)} T_{ex}(\ln\langle T\rangle_a - \ln\langle T\rangle_b) \tag{8}$$

In these two equations $\alpha$ is the coefficient of thermal conduction, which includes the geometric factors A and l from Equation 2, and $\langle T\rangle_a$ and $\langle T\rangle_b$ are the average temperatures in the reaction vessel respectively in modes a and b. The quantities $c_{pi}$ are heat capacities at constant pressures of the reactive species $n_i^{(out)}$ is the change in the number of moles of species i per unit of time due to the flow out of the reaction vessel and $T_{ex}$ is the external temperature.

From Equations 7 and 8, it is seen that if the power output from the piston is positive, the difference $\Delta P$ in power outputs between mode b and mode a is positive and an increase in power output has been achieved. With such an increase in power output in mode b compared to mode a, there occurs a consequent reduction in dissipation. From conservation of energy, we have the condition that if the power output in mode b, $P_b$, is larger than the power output in mode a, $P_a$, then the total work in mode b, per mole of throughput, is larger than that in mode a, that is we have $W_b - W_a > 0$ and therefore, from the first law of thermodynamics $Q_b - Q_a > 0$. Hence, the two modes differ in that for $\Delta P > 0$, in the perturbed mode a larger amount of heat is converted into work per unit time for the same average inflow of chemicals into the reaction chamber.

The difference in the global entropy change (entropy change of the system and the surroundings) per mole of throughput in the mode b minus that of mode a is $$-\frac{Q^{(b)} - Q^{(a)}}{T_{ex}} \tag{9}$$

Hence, if $\Delta P > 0$, then mode (b) has a smaller increase of entropy, a smaller rate of entropy production, and a larger efficiency.

For a given heat leak the comparison of the power output in the externally perturbed mode b and the steady state mode a, Equation 8, is turned to the advantage of the externally perturbed mode. For positive power output by the piston the average temperature in the system in mode b is less than the average temperature in the steady state mode a and hence, in mode b less heat is lost due to the heat leak. The heat thus not lost is turned into work and contributes to the increased power output in the externally perturbed mode .

Figure 5:
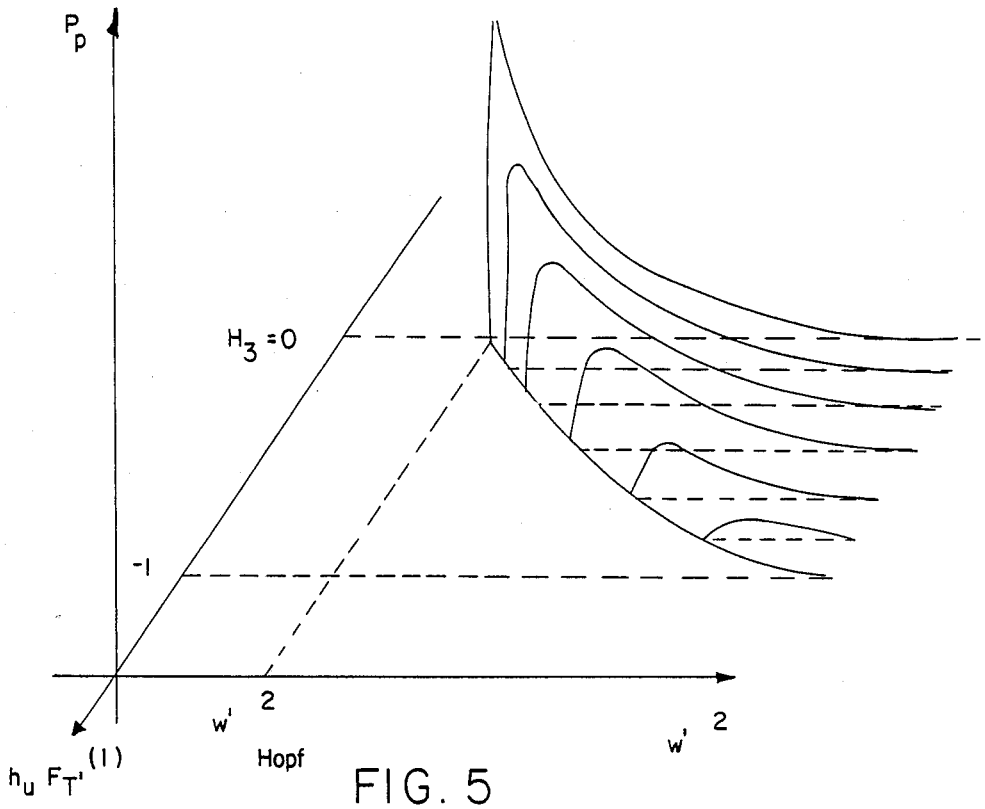
FIG. 5 shows the power output $P_p$ via the piston in the case of a first order chemical reaction.

In the first example, we consider a first order reaction in which the rate coefficient of the reaction is an exponential function of temperature as described in Equation 6. The rate of reaction assumed to occur in the combustion chamber is $$-dA/dT = k(T)A \tag{10}$$

in which A stands for the concentration of the chemical species, t is the time, T the temperature, and k the temperature-dependent rate coefficient. The results of a linear analysis (valid for small perturbations) of the equations of motion of the system, Equation (1) in Reduction of Dissipation in a Thermal Engine by Means of Periodic Changes of External Constraints cited above, are plotted in FIG. 5. $P_p$ denotes the power output of the piston which, if positive, implies that the power output of the externally perturbed mode is larger than that of the steady state mode; $\omega'$ is the dimensionless frequency of the external perturbation. The third axis is labelled by $h_u F_T^{(1)}$, which is the product of the reaction enthalpy and the derivative of the reaction rate with respect to temperature. The two dotted lines intersecting this axis at $-1$ and at $H_3=0$ denote the limits of stability of the system. Similarly, the dotted line labelled $\omega^2_{Hopf}$ denotes the limit of stability on the frequency axis. The region with solid lines shows that there exist conditions for which the unperturbed system has a stable stationary state and for which the power output of the piston is positive, which means that work is done by the system in the surroundings.

The following qualitative arguments provide insight into the advantages of external periodic perturbations. On changing the external pressure, there occurs a change in volume according to Newton's equation for the motion of the piston. A decrease in the volume leads to an increase in the temperature and the internal pressure in the combustion chamber. Changes in the internal temperature and pressure are determined by the equation of state, the chemical reaction, and the coupling of the system to the externally perturbed pressure. The equations of dynamics yield the relative phase of the external pressure and the volume. The sign and magnitude of this phase determines the sign and magnitude of the work done by the piston in the surroundings. In the absence of a chemical reaction, the maximum of the volume lags behind the minimum of the external pressure due to the dissipative processes of heat conduction and transport of matter through the vessel. For such phase relations of the volume to the external pressure to work produced by the piston in the surroundings is negative, that is work has to be done by the surroundings on the piston. The non-linearities in the chemical reaction, however, provide a new channel of interaction and new phase relations among the variables, the volume, the temperature and the pressure in the system. Again, an increase in external pressure induces a decrease in the volume and the compression increases the internal temperature. Conduction of heat from the system to the surroundings tends to reduce this increase but for an exothermic reaction, due to the non-linear exponential increase of reaction rate with increasing temperature, the increase of heat produced by the reaction per degree change in temperature is larger than the losses due to heat conduction and transport of matter. Hence, due to the non-linearity of the temperature dependence of the rate coefficient, there is a positive feedback loop such that an increase in external pressure increases the temperature and pressure in the system to an extent that the external pressure and volume of the system are phase-shifted so that positive work is produced in the surroundings by the piston.

A second example is a second-order reaction in which the rate of change of concentration of a chemical species F (symbolically denoting the fuel) is given by the equation $$\frac{dF}{dt} = kFA \tag{11}$$

where t denotes the time, F is the concentration of a fuel, A the concentration of another chemical (such as air or oxygen), and k a rate coefficient assumed here to be constant. In this example, we stress the non-linearity of the volume-dependence of the reaction rate which in Equation 11 is $V^{-2}$. The example is arbitrary and any chemical reaction with an inverse volume dependence larger than unity is covered by this example.

Figure 6:
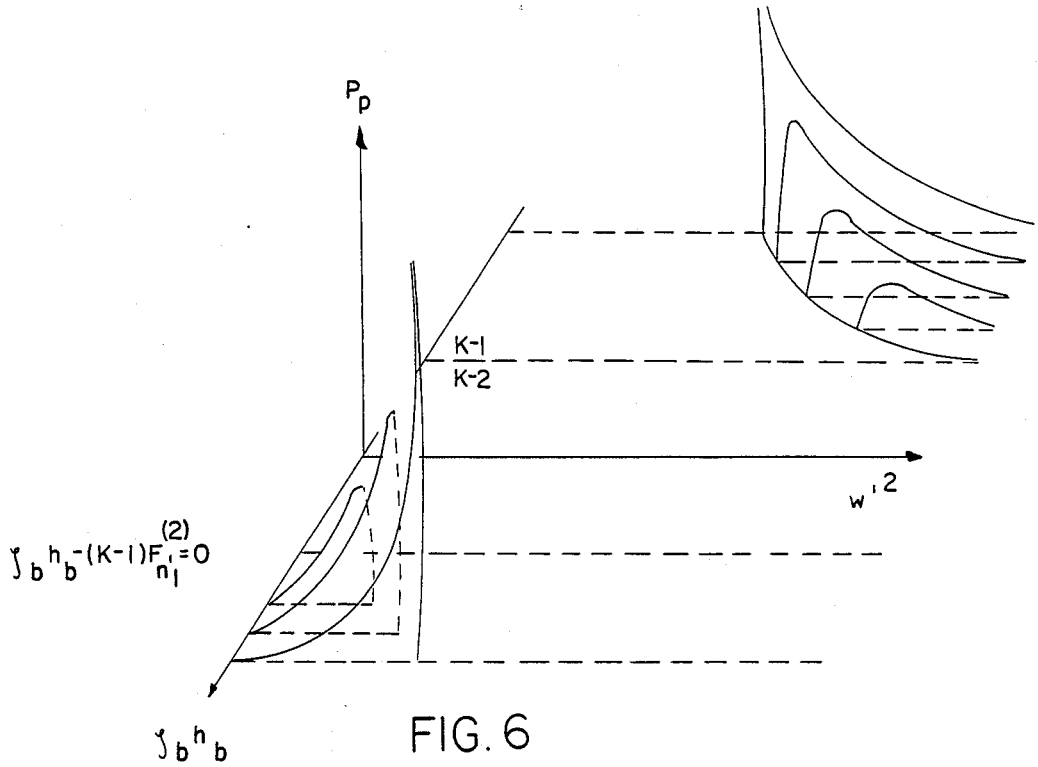
FIG. 6 shows the power output $P_p$ via the piston in the case of a second cycle reaction.

The equations of dynamics can be solved analytically in the linear regime in which there occur only small perturbations from stationary state. The results of the linear analysis are shown in FIG. 6. On one axis, there is plotted the power output by the piston and, if that is positive, the externally perturbed mode is more efficient than the stationary state mode. On the second axis is plotted the frequency of external perturbation, and on the third axis a quantity proportional to the rate of change of enthalpy due to the reaction. The remaining symbols are: $F_{nl}'^{(2)}$, which is the derivative of the reaction rate with respect to the mole fraction of the chemical species labelled l; k is the ratio of the ideal gas constant R to the molar heat capacity of the system at constant volume. The only parts of the surface indicated are those for which power output due to the piston is positive (work done by the system in the surroundings) and where the unperturbed system has a stable stationary state. The front part of the figure corresponds to endothermic reactions and the back part of the figure to exothermic reactions. The dotted lines parallel to the axis on which the frequency is plotted denote limits of stability of the unperturbed system. Thus, positive power output is obtained for both endothermic and exothermic reactions.

If the external pressure is increased, the volume decreases. The reaction rate is inversely proportional to the square of the volume and hence, on decreasing the volume the reaction rate increases non-linearly and so does the rate of enthalpy production due to the exothermic reaction (similar argument can be presented for endothermic reactions). For these reasons, the temperature continues to increase even after the minimum volume of the system is reached, provided that the thermal conduction from the combustion chamber to the surroundings is not too large; hence, the internal pressure is larger on the expansion stroke than on compression and the system, through the piston, will do work in the surroundings.

Figure 7:
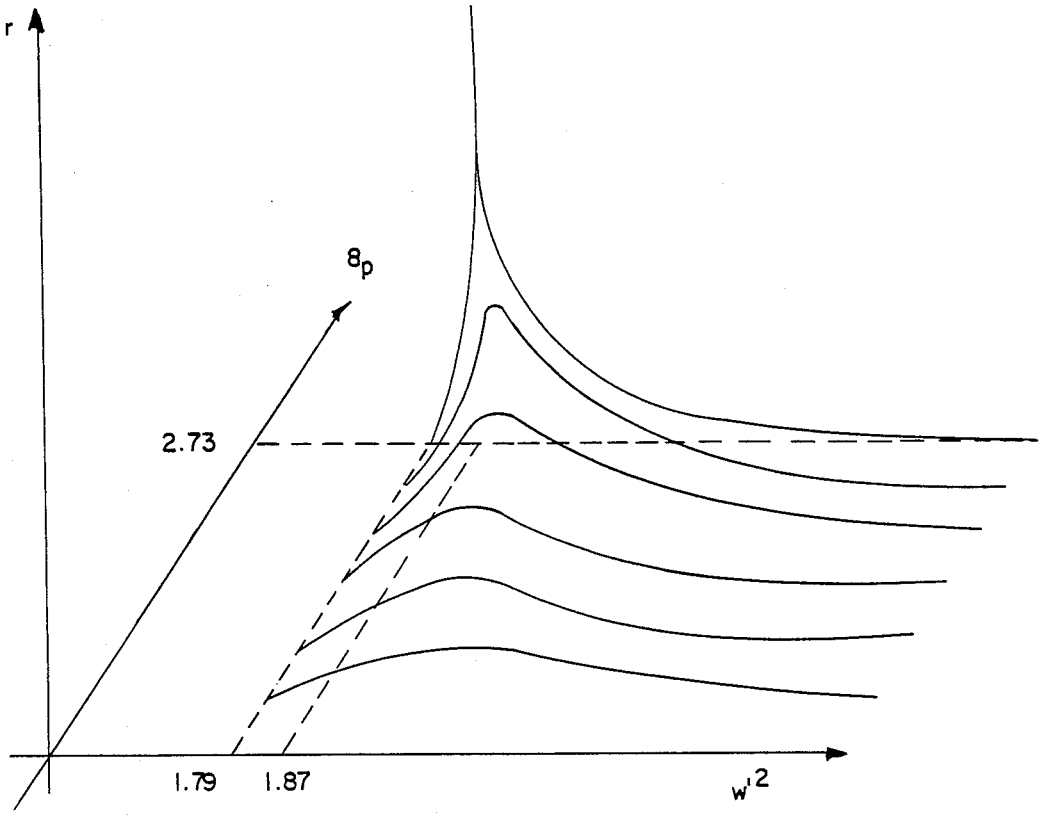
FIG. 7 shows a plot of the relative power which results from a thermal engine driven by the chemical reaction $CO + N_2O \rightarrow H_2 + CO_2$ when the system is perturbed by an external harmonic pressure variation.

As an example of arbitrary chemical reaction, consider the second-order reaction, $CO+N_2O \rightarrow N_2+CO_2$. Realistic values of the rate coefficient, heat capacities, concentrations, and other parameters, are chosen as listed in Section F of the article entitled, "Increased Power Output and Resonance Effects in a Thermal Engine Driven by a First or Second Order Reaction" cited above. The results of operating an engine are shown in FIG. 7. The calculation is again based on a linear analysis of the dynamic equations. In FIG. 7, one axis is labelled $\Gamma$ which is the ratio of the difference in power output of the piston and heat engine in the externally perturbed mode minus the power output of the heat engine in the steady state mode divided by the power output of the heat engine in the steady state mode; thus $\Gamma$ is the relative power gain. The second axis is labelled with $\omega'$ which is frequency of the external perturbation and the third axis is labelled by the symbol $\delta_b$ which equals $0.8\ A^2/m_p$ where A is the surface area of the piston and $cm^2$ and $m_p$ equals the mass of the piston in grams. The dotted line perpendicular to the axis labelled $\delta_b$ gives the limit of stability of the unperturbed state. Below $\omega'^2=1.79$, the relative power gain is negative and is not shown.

Although the invention has been described in terms of pressure/volume variation coupled to a non-linearity in the reaction system, other common non-linearities may be used, such as reactions in which the rate depends on concentration of the reactants.

What is claimed is:

1. A method of increasing the efficiency of a thermal engine of the type which includes a primary heat engine and a source of heat for the engine which comprises the steps of generating heat in the heat source by a non-linear chemical reaction of reactants, supplying heat from the reaction to the heat engine and externally perturbing by varying at predetermined frequency one or more of the thermo-dynamic variables of the non-linear chemical reaction in the heat source to reduce dissipation and thereby increase the total power output.

2. A method as in claim 1 wherein the external pressure applied to the reaction is perturbed.

3. A method as in claim 1 in which the external perturbations are periodic.

4. A method as in claim 3 in which the external perturbations are sinusoidal.

5. The method as in claim 1 wherein the chemical concentration of the reactants is perturbed.

6. The method as in claim 1 in which the concentration of one or more chemical reactants are externally perturbed.

7. The method as in claim 1 in which the chemical reaction is exothermic.

8. The method as in claim 1 in which the chemical reaction is endothermic.

9. The method of increasing the efficiency of a thermal engine of the type which includes a primary heat engine and a source of heat for the engine which comprises the steps of generating heat by a non-linear chemical reaction of reactants, supplying heat from the heat source to the heat engine and externally perturbing by varying at predetermined frequency one of conjugate thermodynamic variables of said non-linear chemical reaction, the other of which perturbs the chemical reaction to reduce dissipation and thereby increase the power output.

10. The method as in claim 1 in which the conjugate quantities are pressure/volume.

11. The method as in claim 9 in which the conjugate quantities are phase shifted to provide positive power.

12. The method of increasing the efficiency of a thermal engine which comprises the steps of generating heat by a non-linear reaction of reactants and externally perturbing by varying at a predetermined frequency one or more of the thermodynamic variables of said non-linear chemical reaction.

* * * * *